US007077089B2

(12) United States Patent
Hudak

(10) Patent No.: US 7,077,089 B2
(45) Date of Patent: Jul. 18, 2006

(54) OIL DRAINBACK SYSTEM FOR INTERNAL COMBUSTION ENGINE

(75) Inventor: Eric Hudak, Sheboygan, WI (US)

(73) Assignee: Kohler Company, Kohler, WI (US)

( * ) Notice: Subject to any disclaimer, the term of this patent is extended or adjusted under 35 U.S.C. 154(b) by 0 days.

(21) Appl. No.: 10/642,374

(22) Filed: Aug. 15, 2003

(65) Prior Publication Data

US 2005/0034697 A1 Feb. 17, 2005

(51) Int. Cl.
*F01L 1/18* (2006.01)

(52) U.S. Cl. ..... 123/90.41; 184/6.5; 123/196 R

(58) Field of Classification Search .. 123/90.11–90.17, 123/90.48–90.59, 90.33–90.34, 193.5, 193.3–193.6, 123/193.4, 90.31, 90.27, 90.16, 196 M, 196 R, 123/196 W, 196 CP, 196 S, 90.41; 184/6.5
See application file for complete search history.

(56) References Cited

U.S. PATENT DOCUMENTS 4,024,846 A * 5/1977 MacGuire ..... 123/574
4,404,936 A * 9/1983 Tatebe et al. ..... 123/196 R
4,579,092 A * 4/1986 Kandler ..... 123/41.86
4,688,529 A * 8/1987 Mitadera et al. ..... 123/196 R
4,771,745 A 9/1988 Nakamura et al.
5,072,809 A 12/1991 Shibata
5,479,886 A 1/1996 Leonard et al.
5,588,408 A * 12/1996 Kurihara ..... 123/196 W
5,611,301 A * 3/1997 Gillbrand et al. ..... 123/48 C
5,803,083 A * 9/1998 Buck et al. ..... 600/439
5,852,992 A 12/1998 Boggs et al.
5,975,042 A * 11/1999 Aizawa et al. ..... 123/196 M
6,167,990 B1 * 1/2001 Peng ..... 184/6.2
6,213,079 B1 * 4/2001 Watanabe ..... 123/196 R
6,305,420 B1 10/2001 Atkinson et al.
6,345,613 B1 * 2/2002 Hoffmann et al. ..... 123/572
6,394,060 B1 * 5/2002 Nagai et al. ..... 123/196 R
6,412,478 B1 * 7/2002 Ruehlow et al. ..... 123/572

* cited by examiner

*Primary Examiner*—Thomas Denion
*Assistant Examiner*—Zelalem Eshete
(74) *Attorney, Agent, or Firm*—Quarles & Brady LLP

(57) ABSTRACT

An internal combustion engine having an oil drainback passage and integral check valve. The oil drainback passage allows the flow of oil from the valve box to the crankcase of the engine during normal operation and prevents the backwards flow of oil from the crankcase to the valve box when high pressures exist in the crankcase or if the engine is operated at elevated angles. The oil drainback passage is formed by a bore through a cylinder wall of the crankcase and a bore through the cylinder head. The check valve includes a cavity within the cylinder wall of the crankcase, located at the end of the bore in the cylinder wall where it meets the bore in the cylinder head, and a check ball disposed within the cavity. During normal operation, the check ball floats within the cavity and allows the flow of oil through the oil drainback passage back to the crankcase. If high crankcase pressures exist, or if the engine is operated at an elevated angle, the check ball will seat against the end of the bore in the cylinder head and prevent the backward flow of oil through the drainback passage to the valve box.

14 Claims, 6 Drawing Sheets

OIL DRAINBACK SYSTEM FOR INTERNAL COMBUSTION ENGINE

FIELD OF THE INVENTION

The present invention relates to internal combustion engines. In particular, the present invention relates to oil drainback systems for internal combustion engines.

BACKGROUND OF THE INVENTION

Internal combustion engines require oil, or some other form of lubricant, to lubricate the various moving parts of the engine. In standard internal combustion engines, this is accomplished by storing the oil in a crankcase and supplying oil from the crankcase to the various moving parts through some type of distribution system. The oil from the various parts of the engine is then returned to the crankcase via some type of drainback system, such as a drainback passage.

For example, oil from the crankcase of a standard internal combustion engine is supplied from the crankcase to the valve train to lubricate the valves, rocker arms, and other parts of the valve train. The oil from the valve train passes through the cylinder head of the engine and back to the crankcase through a drainback passage.

However, under certain operating conditions, this standard drainback system poses some drawbacks. For example, under conditions when high crankcase pressure exists, oil from the crankcase can be forced backwards through the drainback passage, possibly filling the cylinder head and valve box with oil. Similarly, if the engine were operated at an elevated angle (e.g. tilted backwards), oil from the crankcase could flow backwards through the drainback passage, again possibly filling the cylinder head and valve box with oil. If the cylinder head and valve box were filled with oil, the operation of the air intake, air exhaust, and spark plug, which are located in the cylinder head, could be interrupted and oil could possible flow through the valves into the cylinder.

It would therefore be advantageous if an internal combustion engine could be designed that prevented oil from the crankcase from filling the cylinder head and/or valve box of the engine. In particular, it would be advantageous if the oil drainback system of the internal combustion engine could be designed to allow the flow of oil through the drainback passage from the valve box to the crankcase during normal operation and to prevent the flow of oil through the drainback passage from the crankcase to the valve box during certain operating conditions, such as when high pressure is present in the crankcase or during operation at an elevated angle.

SUMMARY OF THE INVENTION

One aspect of the present invention is an internal combustion engine having a crankcase that has walls that define an interior volume for containing oil. A cylinder head has a proximal end that is fastened to the crankcase and extends laterally outward from the crankcase and terminates at a distal end. A rocker arm cover is fastened to the distal end of the cylinder head and defines a cavity that forms a valve box. A drainback passage interconnects the interior volume of the crankcase and the valve box to enable the flow of fluid from the valve box to the interior volume of the crankcase. A check valve is located within the drainback passage and allows the flow of fluid from the valve box to the interior volume of the crankcase and prevents the flow of fluid from the interior volume of the crankcase to the valve box.

This allows oil from the valve box to drain back to the crankcase during normal operation and prevents oil from traveling backwards through the drainback passage (into the valve box) when the pressure in the crankcase is increased or the angle of operation of the engine increases.

Another aspect of the present invention is an internal combustion engine where the cylinder head has a bore formed therethrough that extends from the proximal to the distal end. The crankcase has a cylinder that has a cylinder wall integrally formed in one of the walls of the crankcase. The cylinder wall has a bore formed therethough that extends from an interior surface of the cylinder wall, which communicates with the interior volume of the crankcase, to an exterior surface of the cylinder wall, which engages the proximal end of the cylinder head. The bore in the cylinder head and the bore is the cylinder wall together define the drainback passage. In addition, the bore in the cylinder wall is enlarged at one end to form a cavity in the exterior surface of the cylinder wall and a check ball is disposed within the cavity. The cavity and the check ball together define the check valve. The check ball seats against the bore at the proximal end of the cylinder head to prevent the flow of fluid from the interior volume of the crankcase to the valve box when there is high pressure present within the crankcase or when the engine is operated at an elevated angle.

DETAILED DESCRIPTION OF THE PREFERRED EMBODIMENT

Figure 1:
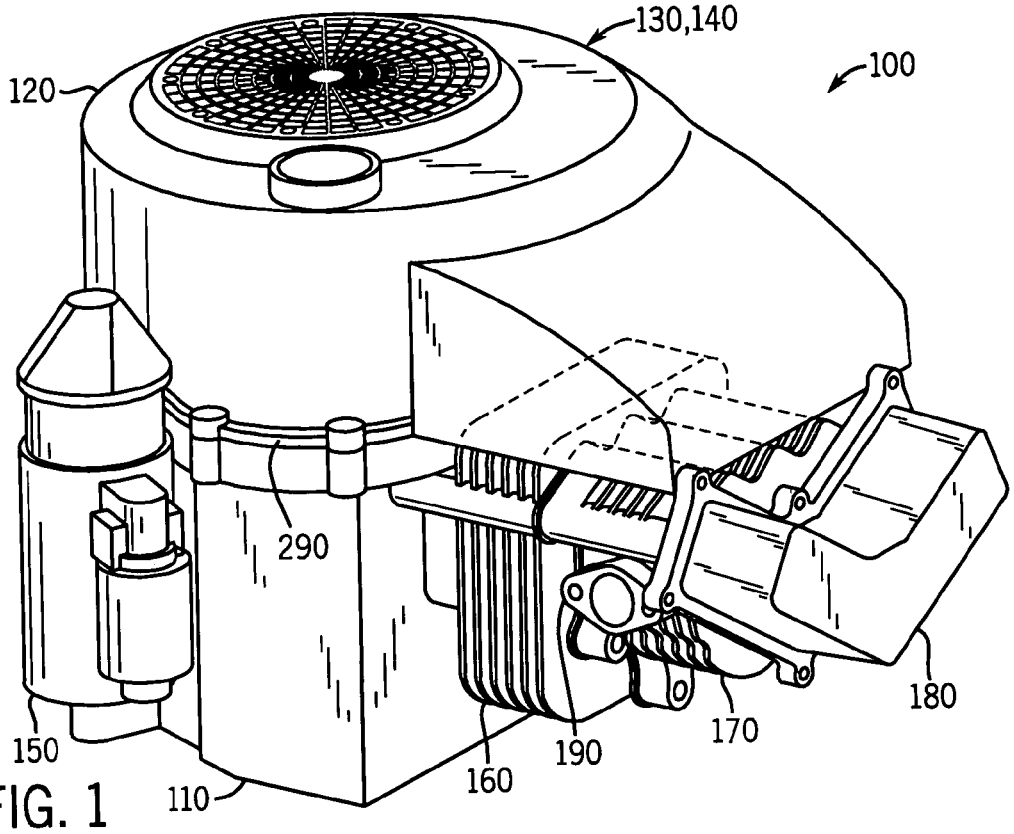
FIG. 1 is a first perspective view of a single cylinder engine, taken from a side of the engine on which are located a starter and cylinder head.
Figure 2:
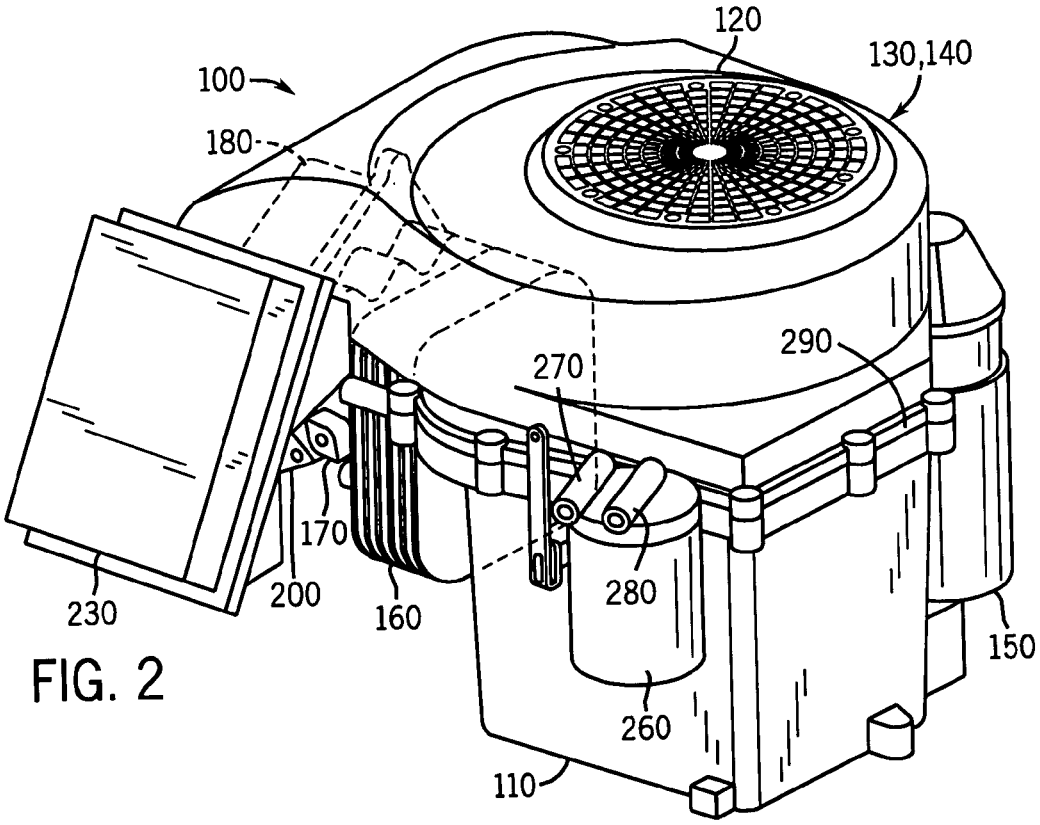
FIG. 2 is a second perspective view of the single cylinder engine of FIG. 1, taken from a side of the engine on which are located an air cleaner and oil filter.

Referring to FIGS. 1 and 2, a single cylinder, 4-stroke, internal combustion engine 100 designed by Kohler Co. of Kohler, Wis. includes a crankcase 110 having a cylinder 160 formed in a sidewall of the crankcase 110, a cover 290 fastened to the top of the crankcase 110, and a blower housing 120 mounted on top of the cover 290. Inside of the blower housing 120 are a fan 130 and a flywheel 140. The engine 100 further includes a starter 150 mounted to the cover 290 and a cylinder head 170, which has a proximal end fastened to the crankcase 110 and extends laterally outward from the sidewall of the crankcase 110 to terminate at a distal end. A rocker arm cover 180 is fastened to the distal end of the cylinder head 170 and defines a cavity therein which forms a valve box, which houses the valves and other components of the valve train, which are discussed in more detail below. Attached to the cylinder head 170 are an air exhaust port 190 shown in FIGS. 1 and 2 and an air intake port 200 shown in FIGS. 2 and 3.

As is well known in the art, during operation of the engine 100, a piston 210 (see FIG. 7) moves back and forth within the cylinder 160 towards and away from the cylinder head 170. The movement of the piston 210 in turn causes rotation of a crankshaft 220 (see FIG. 7), as well as rotation of the fan 130 and the flywheel 140, which are coupled to the crankshaft 220. The rotation of the fan 130 cools the engine, and the rotation of the flywheel 140, causes a relatively constant rotational momentum to be maintained.

Referring specifically to FIG. 2, the engine 100 further includes an air filter 230 coupled to the air intake port 200, which filters the air required by the engine prior to the providing of the air to the cylinder head 170. The air provided to the air intake port 200 is communicated into the cylinder 160 by way of the cylinder head 170, and exits the engine by flowing from the cylinder 160 through the cylinder head 170 and then out of the air exhaust port 190. The inflow and outflow of air into and out of the cylinder 160 by way of the cylinder head 170 is governed by an input valve 240 and an output valve 250, respectively (see FIG. 8). Also as shown in FIG. 2, the engine 100 includes an oil filter 260 mounted to the cover 290, opposite the starter 150, through which the oil of the engine 100 is passed and filtered. Specifically, the oil filter 260 is coupled to the crankcase 110 by way of incoming and outgoing lines 270, 280, respectively, whereby pressurized oil is provided into the oil filter 260 and then is returned from the oil filter 260 to the crankcase 110.

Figure 3:
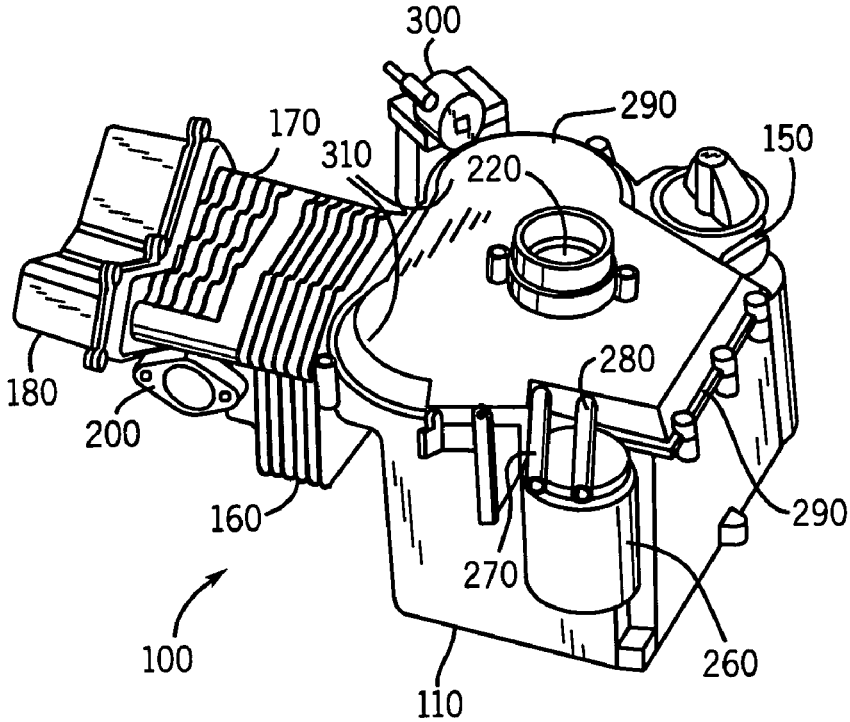
FIG. 3 is a third perspective view of the single cylinder engine of FIG. 1, in which certain parts of the engine have been removed to reveal additional internal parts of the engine.
Figure 4:
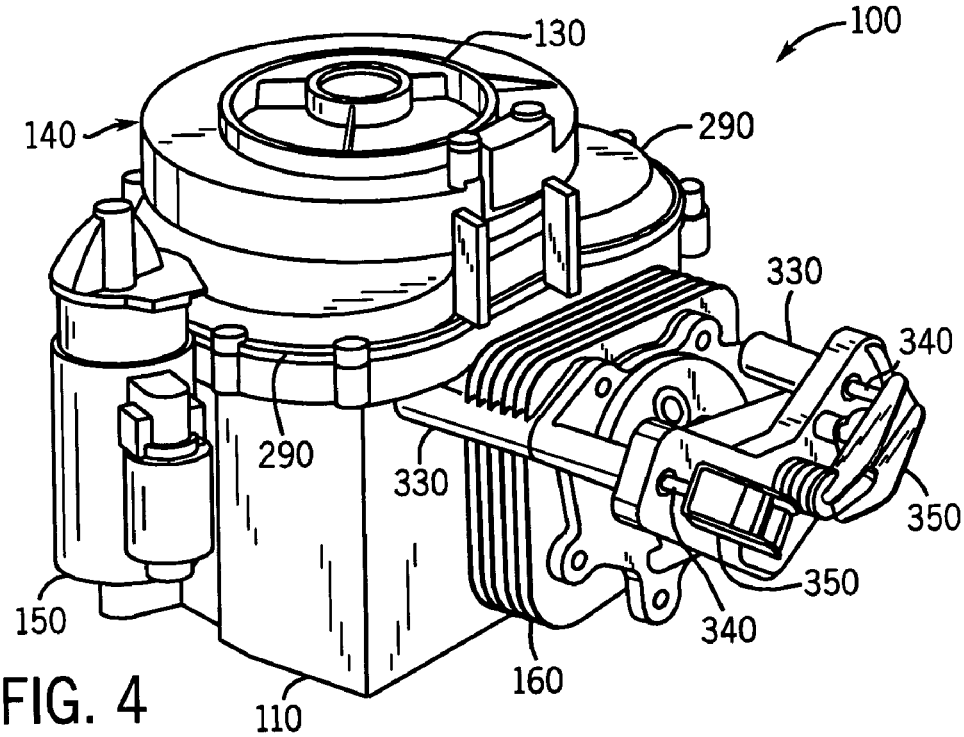
FIG. 4 is a fourth perspective view of the single cylinder engine of FIG. 1, in which certain parts of the engine have been removed to reveal additional internal parts of the engine.

Referring to FIGS. 3 and 4, the engine 100 is shown with the blower housing 120 removed to expose the cover 290 of the crankcase 110. With respect to FIG. 3, in which both the fan 130 and the flywheel 140 are also removed, a coil 300 is shown that is mounted to the cover 290 and generates an electric current based upon rotation of the fan 130 and/or the flywheel 140, which together operate as a magneto. Additionally, the cover 290 of the crankcase 110 is shown to have a pair of lobes 310 that cover a pair of gears 320 (see FIGS. 5 and 7–8). With respect to FIG. 4, the fan 130 and the flywheel 140 are shown above the cover 290 of the crankcase 110. Additionally, FIG. 4 shows the engine 100 without the cylinder head 170 and without the rocker arm cover 180, to more clearly reveal a pair of tubes 330 through which extend a pair of respective push rods 340. The push rods 340 extend between a pair of respective rocker arms 350 and a pair of cams 360 (see FIG. 8) within the crankcase 110, as discussed further below.

Figure 5:
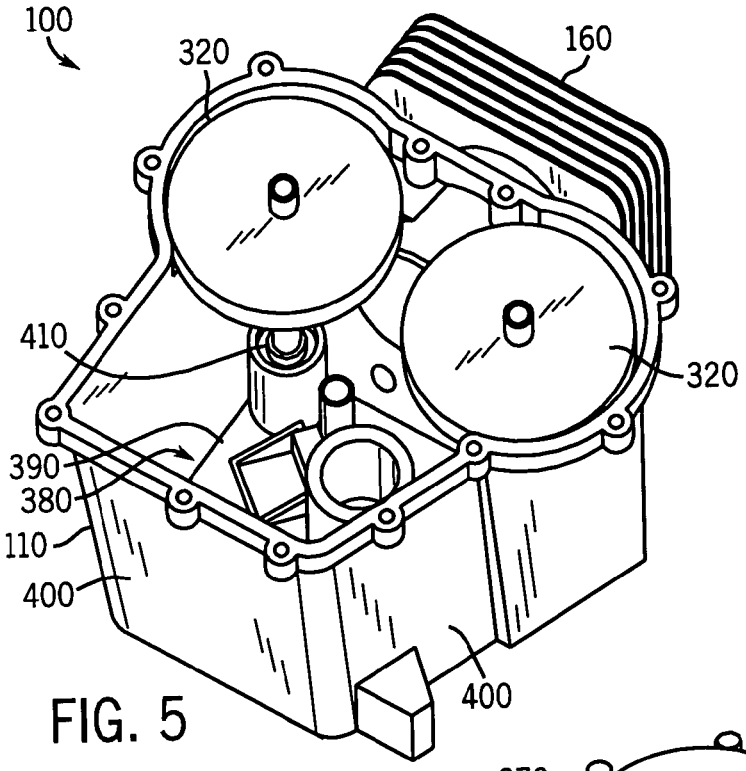
FIG. 5 is fifth perspective view of portions of the single cylinder engine of FIG. 1, in which a top of the crankcase has been removed to reveal an interior of the crankcase.
Figure 6:
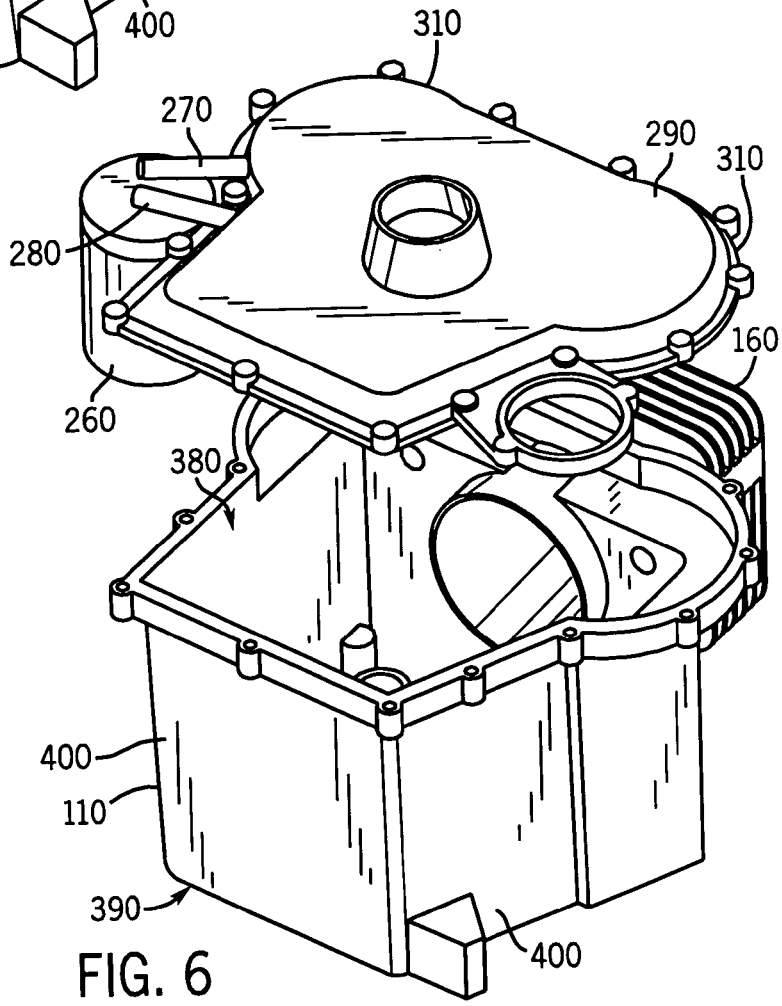
FIG. 6 is a sixth perspective view of portions of the single cylinder engine of FIG. 1, in which the top of the crankcase is shown exploded from the bottom of the crankcase.

Turning to FIGS. 5 and 6, the engine 100 is shown with the cover 290 removed from the crankcase 110 and is shown in cut-away to exclude portions of the engine that extend beyond the cylinder 160 such as the cylinder head 170. With respect to FIG. 6, the cover 290 of the crankcase 110 is shown above the crankcase 110 in an exploded view. The crankcase 110 includes a bottom wall 390 and a series of upright side walls 400 that define an interior volume 380 for containing oil. The cover 290 and crankcase 110 are manufactured as two separate pieces such that, in order to access the interior volume 380 of the crankcase 110, one physically removes the cover 290 from the crankcase 110. Also, as shown in FIG. 5, the pair of gears 320 within the crankcase 110 are supported by and rotate upon respective shafts 410, which in turn are supported by the bottom wall 390 of the crankcase 110.

Figure 7:
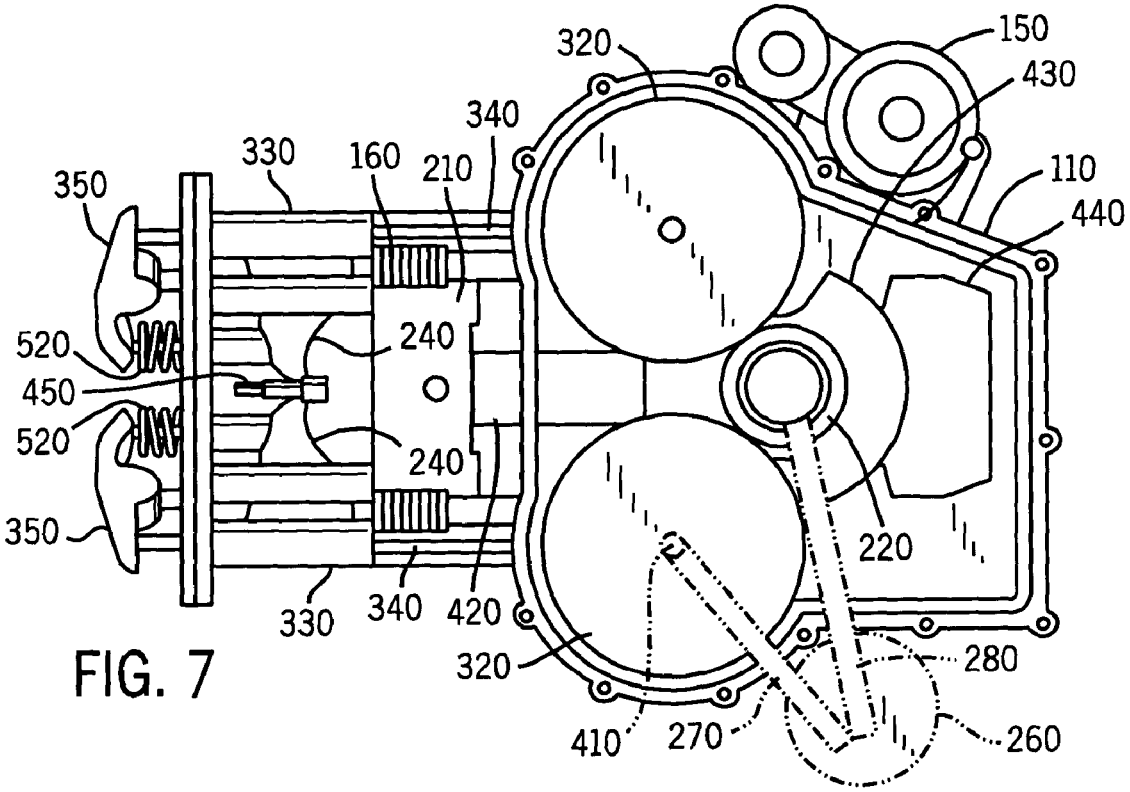
FIG. 7 is a top view of the single cylinder engine of FIG. 1, showing internal components of the engine in grayscale.

Referring to FIG. 7, a top view of the engine 100 is provided in which additional internal components of the engine are shown in grayscale. In particular, FIG. 7 shows the piston 210 within the cylinder 160 to be coupled to the crankshaft 220 by a connecting rod 420. The crankshaft 220 is in turn coupled to a rotating counterweight 430 and reciprocal weights 440, which balance the forces exerted upon the crankshaft 220 by the piston 210. The crankshaft 220 further is in contact with each of the gears 320, and thus communicates rotational motion to the gears. In the present embodiment, the shafts 410 upon which the gears 320 are supported are capable of communicating oil from the bottom wall 390 of the crankcase 110 (see FIG. 5) upward to the gears 320. The incoming line 270 to the oil filter 260 is coupled to one of the shafts 410 to receive oil, while the outgoing line 280 from the oil filter is coupled to the crankshaft 220 to provide lubrication thereto. FIG. 7 further shows a spark plug 450 located on the cylinder head 170, which provides sparks during power strokes of the engine to cause combustion to occur within the cylinder 160. The electrical energy for the spark plug 450 is provided by the coil 300 (see FIG. 3).

Figure 8:
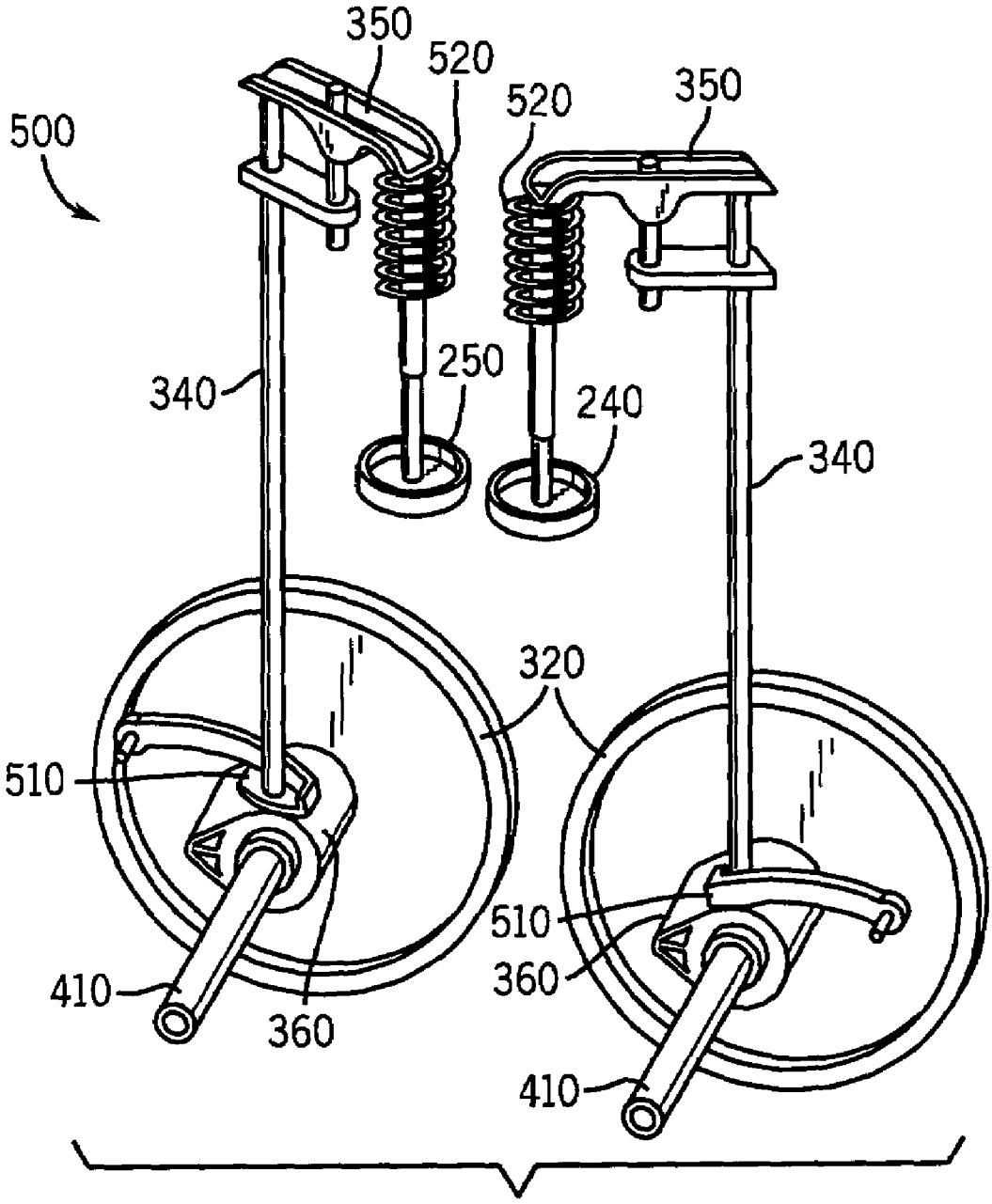
FIG. 8 is a perspective view of components of a valve train of the single cylinder engine of FIG. 1.

Further referring to FIG. 7, and additionally to FIG. 8, elements of a valve train 500 of the engine 100 are shown. The valve train 500 includes the gears 320 resting upon the shafts 410 and also includes the cams 360 underneath the gears, respectively. Additionally, respective cam follower arms 510 are rotatably mounted to the crankcase 110 and extend to rest upon the respective cams 360. The respective push rods 340 in turn rest upon the respective cam follower arms 510. As the cams 360 rotate, the push rods 340 are temporarily forced outward away from the crankcase 110 by the cam follower arms 510. This causes the rocker arms 350 to rock or rotate, and consequently causes the respective valves 240 and 250 to open toward the crankcase 110. As the cams continue to rotate, however, the push rods 340 are allowed by the cam follower arms 510 to return inward to their original positions. A pair of springs 520 positioned between the cylinder head 170 and the rocker arms 350 provide force tending to rock the rocker arms in directions tending to close the valves 240, 250, respectively. Further as a result of this forcing action of the springs 520 upon the rocker arms 350, the push rods 340 are forced back to their original positions.

Figure 9:
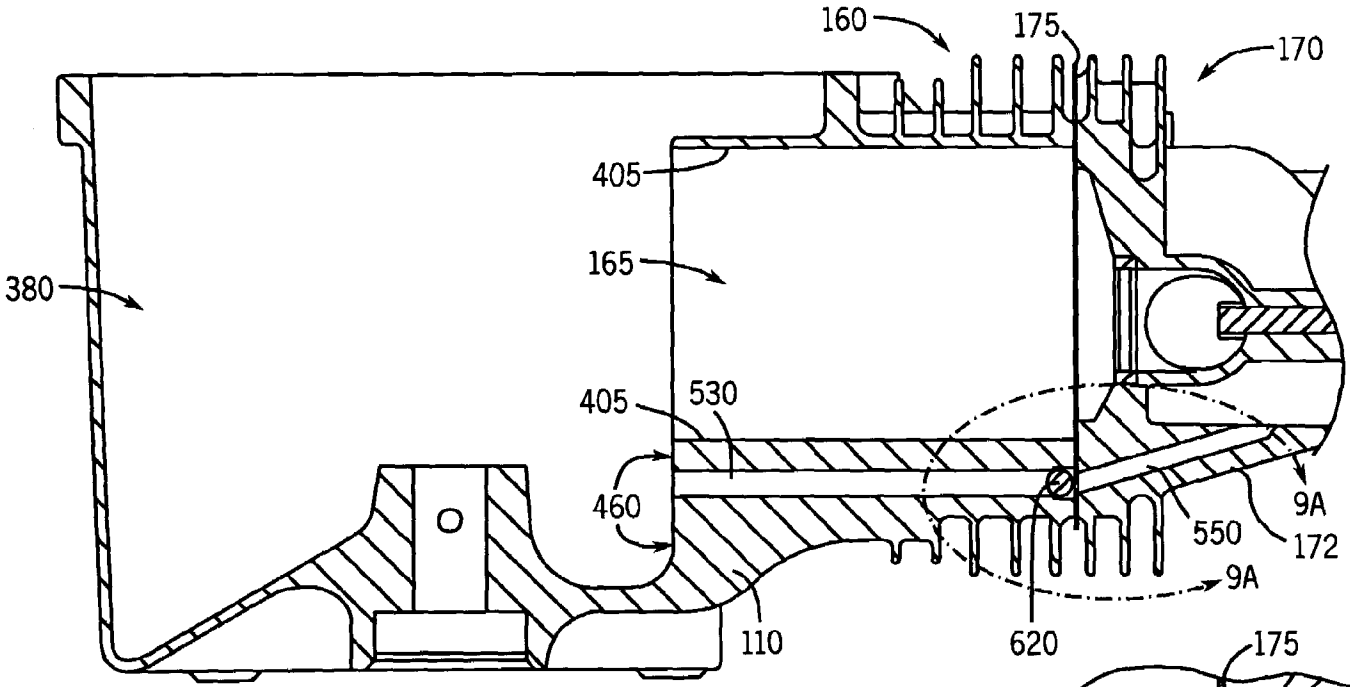
FIG. 9 is a cross sectional view of portions of the single cylinder engine of FIG. 1.
Figure 9A:
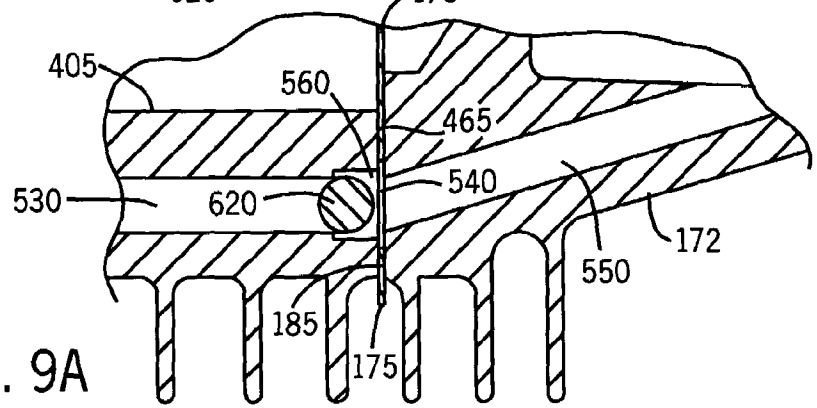
FIG. 9*a* is an enlarged view of the check valve of FIG. 9.

Referring to FIGS. 9 and 9*a*, a cross sectional view of the crankcase 110 and cylinder head 170 of the internal combustion engine 100 is shown. Formed in a lower wall 172 of the cylinder head 170 is a bore 550, which extends from the valve box at the distal end of the cylinder head 170 to a sealing surface 185 at the proximal end of the cylinder head 170. During normal engine operation this bore 550 extends substantially horizontal, but is tilted downward to enable oil to drain from the valve box by gravity.

The cylinder 160 has a cylindrical cylinder wall 405 integrally molded into one of the crankcase walls 400. The cylinder wall 405 defines a cavity within the cylinder 160 that forms a cylinder cavity 165, which receives the piston (not shown). The cylinder wall 405 below the cylinder cavity 165 presents an interior surface 460 that communicates with the interior volume 380 of the crankcase 110 and an exterior surface 465 that engages the sealing surface 185 on the cylinder head 170.

A cylindrical bore 530 is formed in the cylinder wall 405 below the cylinder cavity 165 and it extends from the cylinder wall interior surface 460, where it communicates with the crankcase interior volume 380, to the cylinder wall exterior surface 465, where it aligns with and couples to the bore 550 in the cylinder head 170. The bore 550 in the cylinder head and the bore 530 in the cylinder wall 405 together define an oil drainback passage that enables oil collected in the valve box to flow back to the crankcase interior volume 380.

The outer end of the bore 530 is enlarged to form a cavity 560 in the cylinder wall exterior surface 465. A check ball 620 is received in this cavity 560 to form a check valve, which enables oil to flow out of the valve box through the bore 550 during normal engine operation, but prevents oil from flowing from the crankcase bore 530 back to the valve box during certain circumstances, such as times when increased crankcase pressure is present or operation at an elevated angle, as described in more detail below.

The check ball 620 is preferably made of a fluorocarbon material, which is able to withstand high temperature and is highly resistant to oil absorption and wear. However, the check ball 620 can also be made of any other material that can perform the sealing required, as described below. Alternatively, the check valve could also be a reed valve, a check disk, a ball valve, or any other type check valve or similar type one-way flow sealing device located within the oil drainback passage that would allow the flow of oil from the valve box to the interior volume 380 of the crankcase 110 during normal operation of the engine 100 and prevent the flow of oil from the interior volume 380 of the crankcase 110 to the valve box during certain operating conditions, such as when high pressure is present in the crankcase or during operation at an angle.

A head gasket 175 is disposed between the crankcase 110 and the cylinder head 170 to prevent the leakage of oil from between the cylinder wall exterior surface 465 and the cylinder head sealing surface 185. The head gasket 175 has an aperture 540 that is aligned with the bores 530, 550 to allow oil to flow through the head gasket 175.

In alternate embodiments of the invention, the drainback passage does not have to be integral to the cylinder head and crankcase as described above. The drainback passage could connect the valve box to the internal volume of the crankcase in any manner, such as externally via a hose, tube, or other method, and have some type of check valve therein.

During normal operation of the engine 100 (i.e. at times in the engine cycle where low crankcase pressure exists and the engine is not being operated at an elevated angle) the check ball 620 floats within the cavity 560 allowing oil to flow through the cavity 560 and past the check ball 620. This allows oil from the valve box to flow through the bore 550 in the cylinder head 170, through the aperture 540 in the head gasket 175, around the check ball 620, and through the bore 530 in the side wall 400 back to the crankcase 110.

At times in the engine cycle where high crankcase pressures exist, the pressure in the crankcase bore 530 increases and forces the check ball 620 towards the cylinder head 170. When this occurs, the check ball 620 passes through the aperture 540 in the head gasket 175 and seats against the bore 550 at the seating surface 185 of the cylinder head 170. Similarly, if the engine 100 is operated at an elevated angle, the check ball 620 moves towards the cylinder head 170. When this occurs, the check ball 620 again passes through the aperture 540 in the head gasket 175 and seats against the bore 550 at the sealing surface 185 of the cylinder head 170. The seating of the check ball 620 against the bore 550 closes the oil drainback passage and prevents the oil form flowing backwards through the bore 550. This allows the engine 100 to operate during times where high crankcase pressures exist and at elevated angles without the valve box filling with oil.

In the preferred embodiment of the present invention, the check ball 620 prevents the flow of oil backwards through the bore 550 in the cylinder head 170 by seating against the bore 550 at the distal end of the cylinder head 170. However, the check ball 620 could seat against any surface anywhere along the oil drainback path. For example, if the aperture 540 in the head gasket 175 were made smaller the check ball 620 would seat against the head gasket 175 rather than passing through, thereby preventing oil from flowing backwards through the bore 550 back into the valve box.

In the present embodiment, the engine 100 is a vertical shaft engine capable of outputting 15–20 horsepower for implementation in a variety of consumer lawn and garden machinery such as lawn mowers. In alternate embodiments, the engine 100 can also be implemented as a horizontal shaft engine, be designed to output greater or lesser amounts of power, and/or be implemented in a variety of other types of machines, e.g., snow-blowers. Further, in alternate embodiments, the particular arrangement of parts within the engine 100 can vary from those shown and discussed above. For example, in one alternate embodiment, the cams 360 could be located above the gears 320 rather than underneath the gears.

While the foregoing specification illustrates and describes the preferred embodiments of this invention, it is to be understood that the invention is not limited to the precise construction herein disclosed. The invention can be embodied in other specific forms without departing from the spirit or essential attributes of the invention. Accordingly, reference should be made to the following claims, rather than to the foregoing specification, as indicating the scope of the invention.

What is claimed is:

1. An internal combustion engine, comprising:

a crankcase having walls which define an interior volume for containing oil and which define a cylinder;

a piston moveably positioned within the cylinder of the crankcase;

a cylinder head having a proximal end fastened to the crankcase, the cylinder head extending laterally outward from the crankcase and terminating at a distal end;

a rocker arm cover, fastened to the distal end of the cylinder head, the rocker arm cover defining a cavity therein which forms a valve box;

a drainback passage interconnecting the interior volume of the crankcase and the valve box to enable the flow of fluid from the valve box to the interior volume of the crankcase; and a check valve, disposed within the drainback passage, for allowing the flow of fluid from the valve box to the interior volume of the crankcase and preventing the flow of fluid from the interior volume of the crankcase to the valve box, wherein the check valve includes a check ball seating against a bore defining at least a portion of the drainback passage at the proximal end of the cylinder head to prevent the flow of fluid from the interior volume of the crankcase to the valve box when there is high pressure present within the crankcase or when the engine is operated at an elevated angle;

whereim the cylinder head has a first bore formed therethrough extending from the distal end to the proximal end of the cylinder head;

the cylinder has a cylinder wall, integrally formed in the one wall of the crankcase and having an interior surface that communicates with the interior volume of the crankcase and an exterior surface that engages the proximal end of the cylinder head; and the cylinder wall has a second bore formed therethrough extending from the interior surface to the exterior surface, where it aligns with and couples to the cylinder head bore, wherein the first bore and the second bore together define the drainback passage, and said check ball is disposed in a cavity formed at one end of said second bore and seats against said second bore to prevent the flow of fluid from the interior volume of the crankcase to the valve box when there is high pressure present within the crankcase or when the engine is operated at an elevated angle.

2. An internal combustion engine, as recited in claim 1, wherein the drainback passage is formed as an integral part of the cylinder head and the crankcase.

3. An internal combustion engine, as recited in claim 1, wherein the check ball is formed of a fluorocarbon material.

4. The internal combustion engine, as recited in claim 1, wherein the check valve is configured so that when the crankcase is tipped beyond a predetermined angle, the check valve substantially prevents the flow of fluid from the interior volume of the crankcase to the valve box regardless of a position of the piston.

5. The internal combustion engine, as recited in claim 1, wherein the check valve allows and prevents the flow of fluid in the drainback passage in response to pressure in the crankcase.

6. An internal combustion engine, comprising:

a crankcase having walls which define an interior volume for containing oil and which define a cylinder;

a piston moveably positioned within the cylinder of the crankcase;

a cylinder head having a proximal end fastened to the crankcase, the cylinder head extending laterally outward from the crankcase and terminating at a distal end;

a rocker arm cover, fastened to the distal end of the cylinder head, the rocker arm cover defining a cavity therein which forms a valve box;

a drainback passage interconnecting the interior volume of the crankcase and the valve box to enable the flow of fluid from the valve box to the interior volume of the crankcase; and a check valve, disposed within the drainback passage, for allowing the flow of fluid from the valve box to the interior volume of the crankcase and preventing the flow of fluid from the interior volume of the crankcase to the valve box, wherein the cylinder head has a first bore formed therethrough extending from the distal end to the proximal end of the cylinder head;

the cylinder has a cylinder wall, integrally formed in the one wall of the crankcase and having an interior surface that communicates with the interior volume of the crankcase and an exterior surface that engages the proximal end of the cylinder head; and the cylinder wall has a second bore formed therethrough extending from the interior surface to the exterior surface, where it aligns with and couples to the cylinder head bore; wherein the first bore and the second bore together define the drainback passage, wherein the check valve comprises:

a cavity in the exterior surface of the cylinder wall at one end of the second bore; and a check ball is disposed within the cavity;

wherein the check ball seats against the second bore at the proximal end of the cylinder head to prevent the flow of fluid from the interior volume of the crankcase to the valve box when there is high pressure present within the crankcase or when the engine is operated at an elevated angle.

7. An internal combustion engine, as recited in claim 6, wherein the check valve comprises a reed valve.

8. An internal combustion engine, as recited in claim 6, wherein the check valve comprises a check disk.

9. An internal combustion engine, as recited in claim 6, wherein the check valve comprises a ball valve.

10. An internal combustion engine, as recited in claim 6, wherein the drainback passage is formed as an integral part of the cylinder head and the crankcase.

11. An internal combustion engine, as recited in claim 6, further comprising a head gasket disposed between the crankcase and the cylinder head, the head gasket having an aperture that is aligned with the first and second bores to allow the flow of fluid therethrough.

12. An internal combustion engine, as recited in claim 6, wherein the check ball is formed of a fluorocarbon material.

13. The internal combustion engine, as recited in claim 6, wherein the check valve is configured so that when the crankcase is tipped beyond a predetermined angle, the check valve substantially prevents the flow of fluid from the interior volume of the crankcase to the valve box regardless of a position of the piston.

14. The internal combustion engine, as recited in claim 6, wherein the check valve allows and prevents the flow of fluid in the drainback passage in response to pressure in the crankcase.

* * * * *